US007466943B2

(12) United States Patent
Hamakawa et al.

(10) Patent No.: US 7,466,943 B2
(45) Date of Patent: Dec. 16, 2008

(54) IMAGE FORMING APPARATUS COMPRISING A DEVELOPER ROLLER

(75) Inventors: Hiroyuki Hamakawa, Osaka (JP); Koji Suenami, Osaka (JP); Hirohisa Endou, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 189 days.

(21) Appl. No.: 11/399,622

(22) Filed: Apr. 7, 2006

(65) Prior Publication Data

US 2006/0245790 A1 Nov. 2, 2006

(30) Foreign Application Priority Data

Apr. 13, 2005 (JP) ..... 2005-115631

(51) Int. Cl.
*G03G 15/00* (2006.01)
*G03G 15/08* (2006.01)

(52) U.S. Cl. ..... 399/236; 399/167

(58) Field of Classification Search ..... 399/167, 399/236

See application file for complete search history.

(56) References Cited

U.S. PATENT DOCUMENTS 4,320,954 A * 3/1982 Ikeda et al. ..... 399/75

FOREIGN PATENT DOCUMENTS

| | | | |
|---|---|---|---|
| JP | 63008773 A | * | 1/1988 |
| JP | 11-174820 | | 7/1999 |
| JP | 2002-040887 | | 2/2002 |
| JP | 2005010562 A | * | 1/2005 |

* cited by examiner

*Primary Examiner*—Ryan Gleitz
(74) *Attorney, Agent, or Firm*—Smith, Gambrell & Russell, LLP

(57) ABSTRACT

A control part 33 rotates a developer roller 21*a* at a second rotation speed, which is slower than a normal rotation speed during an image formation period (first rotation speed), during a non-image formation period while a heater 14 is in use. This prevents deformation of the developer roller 21*a* caused by radiant heat from a photoconductive drum 41, effectively prevents the appearance of image fogging, concentration unevenness, and the like, and also suppresses toner deterioration in a development unit 21.

23 Claims, 6 Drawing Sheets

IMAGE FORMING APPARATUS COMPRISING A DEVELOPER ROLLER

This application is based on Japanese Patent Application No. 2005-115631 filed on Apr. 13, 2005, the contents of which are hereby incorporated by reference.

BACKGROUND OF THE INVENTION

1. Field of the Invention

The invention relates to an image forming apparatus, such as a copier, a facsimile, a printer, or the like, provided with a development unit that agitates and conveys a toner inside the unit and then supplies it to a developer roller, and more specifically to a drive control method of the development unit.

2. Description of Related Art

In recent years, as image carriers for an image forming apparatus using an electrophotographic process, amorphous silicon (hereinafter, referred to as a-Si) photoconductive drums have been widely used. The a-Si photoconductive drum is an excellent image carrier with a high degree of hardness, excellent durability, a capability of maintaining high image quality with little deterioration in its properties as a photoconductor even after its long-term use, which requires low running costs, is easy to handle, and provides a high level of environmental safety.

Such an image forming apparatus using an a-Si photoconductive drum is known to have a property that easily causes image blurring. That is, charging the photoconductive drum by using a charge unit results in ozone generation caused by discharge from the charge unit. This ozone decomposes a component in the air, whereby an ion product, such as NOx, SOx, or the like, is generated. Due to its water-soluble nature, this ion product adheres to the photoconductive drum and enters into a structure formed, with a roughness of approximately 0.1 μm, on the photoconductive drum surface, so that the ion product cannot be removed by a cleaning system used in a general purpose machine. Further, this ion product intakes moisture contained in the air, thereby causing a reduction in the resistance of the photoconductive drum surface. As a result, lateral charge flow occurs at an edge part of an electrostatic latent image formed on the photoconductive drum surface, thus causing image blurring.

FIG. 6 is a schematic diagram showing the configuration of an image formation part of a conventional image forming apparatus. In FIG. 6, disposed along the rotation direction of a photoconductive drum 41 (an arrow A direction) in the image formation part 32 are: a charge part 42, an image writing part (laser scan unit) 43, a development unit 21, a transfer part 45, a cleaning part 46, and an electricity removing device 48.

The photoconductive drum 41 is, for example, formed by laying a photosensitive layer of a-Si on an aluminum drum, and is configured to have its surface charged by the charge part 42. Then, on the surface receiving a laser beam from the image writing part 43 to be described later, an electrostatic latent image is formed which is charged attenuatedly. The charge part (charger) 42 charges the surface of the photoconductive drum 41 through its discharge (for example, corona discharge) which is achieved by, for example, being supplied with a high voltage using a thin wire or the like as an electrode.

The image writing part (LSU) 43, based on image data, irradiates the photoconductive drum 41 with an optical beam (for example, laser beam) to thereby form an electrostatic latent image on the surface of the photoconductive drum 41. The development unit 21 is provided with a developer roller 21*a* that is so arranged as to oppose the photoconductive drum 41, and, by using a developer roller 21*a*, has a toner stored therein adhere to the electrostatic latent image on the photoconductive drum 41 to thereby form a toner image. The toner stored in the development unit 21 is, for example, a two-component toner, composed of a toner component and a carrier, and a one-toner component toner composed of a toner component only.

The cleaning part 46 removes a toner remaining on the surface of the photoconductive drum 41 (residual toner) after a toner image is shifted (transferred) to a sheet, and is composed of, for example, a rubbing roller 11 which is brought by a spring 7 into line contact with the photoconductive drum 41 in the longitudinal direction thereof, a cleaning blade 12, and the like. The electricity removing device 48 exposes the surface of the photoconductive drum 41 to, for example, an LED or the like to thereby remove the surface potential after the toner image is transferred.

As already known, after the removal of electricity by the electricity removing device 48, the electrostatic latent image is recorded by the image writing part 43 onto the photoconductive drum 41 uniformly charged by the charge part 42, then this electrostatic latent image is transformed into a visible toner image by the development unit 21 through reversal development, and then the toner image is transferred onto a sheet 10 by the transfer part 45. The toner not transferred by the transfer part 45 is removed as a residual toner from the surface of the photoconductive drum 41 by the cleaning part 46, and the removed residual toner is transferred by a toner collector, such as a collecting screw 13 or the like, to a waste bottle, not shown.

In the photoconductive drum 41, a heater 14 is arranged. Through electricity distribution to this heater 14, an energy that separates the moisture taken in by the ion product is provided, thereby suppressing a reduction in the resistance of the photoconductive drum 41 surface under high-humidity environments.

FIG. 7 is an enlarged sectional view of a conventional development unit, with the photoconductive drum 41 flipped horizontally from the one shown in FIG. 6. The development unit 21 is configured to include a casing 5, a cover 6, a first agitation screw 7, a second agitation screw 8, the developer roller 21*a*, and a control blade 22. The casing 5 stores a toner, and is formed by partitioning, by the partition plate 9 integrated therewith, a first storage chamber 15 and a second storage chamber 16. In this first storage chamber 15, the first agitation screw 7 is disposed, while the second agitation screw 8 is disposed in the second storage chamber 16.

The first agitation screw 7 conveys a toner or the like stored in the first storage chamber 15 while agitating it and leads it to the second storage chamber 16. The second agitation screw 8 conveys the toner or the like conveyed to the second storage chamber 16 while agitating it and supplies it to the developer roller 21*a*. In both end parts of the casing 5 in the longitudinal direction thereof (the paper surface direction in the figure), the partition plate 9 does not exist, permitting toner reception and delivery between the first agitation screw 7 and the second agitation screw 8. The first agitation screw 7 and the second agitation screw 8 are configured to have helical blades 7*b* and 8*b* provided around their respective centers, i.e., spindles 7*a* and 8*a*, and are rotatably supported in the casing 5 in parallel to each other.

Inside the developer roller 21*a*, a magnetic field generating member 23 is Fixed, which has six magnetic poles 23*a* to 23*f* composed of N poles 23*a*, 23*c*, and 23*e* and S poles 23*b*, 23*d*, and 23*f*. The N pole 23*a* of the magnetic field generating member 23 opposes the control blade 22; thus, the use of a non-magnetic body or a magnetic body of an S pole as the control blade 22 generates a magnetic field in the direction (direction of an arrow C) attracted to a control part 24.

This magnetic field causes the toner to rise in a brush like form between the control blade 22 and the developer roller 21*a*. Then, rotation of the developer roller 21*a* in the direction of an arrow B generates a force acting so as to separate the toner rising in the brush-like form whereby a thin toner layer is formed on the surface of the developer roller 21*a*. When this thin toner layer moves to the position opposing the photoconductive drum 41, a potential difference between the voltage applied to the developer roller 21*a* and the surface potential of the photoconductive drum 41 causes a toner image to be formed onto the surface of the photoconductive drum 41.

Further rotation of the developer roller 21*a* in the direction of the arrow B provides a magnetic field to be attracted by the N pole 23*c*, so that the toner not used for the toner image formation is collected in the development unit 21. Then, after agitated and conveyed by the second agitation screw 8, due to the magnetic fields of the N pole 23*e* and S pole 23*f* the toner adheres again onto the developer roller 21*a*. That is, not only the gap at the control part 24 but also the magnetic field generated at the control part 24 strictly control the thin toner layer on the developer roller 21*a*. In addition, provided at the both axially left and right end parts of the developer roller 21*a* are magnetic seal members (not shown) for preventing the toner held on the developer roller 21*a* surface from leaking outside.

In such a development unit 21, the developer roller 21*a* is so arranged as to oppose, in close proximity to, the photoconductive drum 41. Thus, when the photoconductive drum 41 is hest by using the heater 14 (see FIG. 6) during non-image formation where the developer roller 21*a* is in a resting state, radiant heat from the photoconductive drum 41 causes only the portion of the developer roller 21*a* opposing the photoconductive drum 41 to become locally high in temperature.

Thus, as shown in FIG. 8, the side of the developer roller 21*a* opposing the photoconductive drum 41 thermally expands whereby the developer roller 21*a* is bent axially (indicated by a solid line of FIG. 8 ). As a result, a distance d between the photoconductive drum 41 and the developer roller 21*a* periodically fluctuates when the developer roller 21*a* rotates, thus causing, in particular, periodical image unevenness, such as image fogging on a white paper part, concentration unevenness on a grey image, or the like.

Thus, a method has been proposed which prevents the deformation of the developer roller when a power is distributed to the heater during the non-image formation period. Patent publication 1, for example, discloses a development unit and an image forming apparatus provided with a structure not having a hollow in at least part of the developer roller by stuffing a filling material having a higher heat conductivity than the developer roller. However, the method of patent publication 1 suffers from problems of more complicated structure of the developer roller, a larger number of components used, and higher manufacturing costs of the developer roller and a development unit using this developer roller.

Moreover, there is a possible method in which, as during a image formation period, the developer roller is rotated even during the non-image formation period so as to prevent the developer roller from becoming locally high in temperature. However, unnecessarily driving the development unit results in an increased mechanical stress, thereby promoting toner deterioration in the development unit. Patent publication 2 discloses a method of controlling a heater provided in an image forming apparatus in accordance with the operation mode of each part of the apparatus. However, the method of patent publication 2 does not control the operation of each part of the apparatus in accordance with the operation of the heater, but controls power supply to the heater in accordance with the operation of each part of the apparatus for the purpose of reducing the peak power consumption by the entire apparatus, and thus is not applicable for preventing the deformation of the developer roller.

[Patent Publication 1] JP-A-H11-174820

[Patent Publication 2] JP-A-2002-40887

SUMMARY OF THE INVENTION

In view of the problems described above, the present invention has been made, and it is an object of the invention to provide an image forming apparatus, having a heater provided in a photoconductive drum to prevent image blurring, which prevents deformation of a developer roller caused by the turning on of the heater during a non-image formation period to thereby provide a stable image quality.

To achieve the object described above, one aspect of the invention refers to an image forming apparatus including: an image formation part including: a photoconductive drum, a heater for heating the photoconductive drum to a predetermined temperature, and a development unit for forming a toner image onto the surface of the photoconductive drum in accordance with an electrostatic latent image by rotating a developer roller so arranged as to oppose the photoconductive drum; a driver for driving the image formation part; and a controller for controlling driving of the driver, in which the controller rotates the developer roller at a first rotation speed during an image formation period and rotates the developer roller at a second rotation speed, a speed lower than the first rotation speed, during a non-image formation period while the heater is in use.

According to this configuration, even during the non-image formation period, the developer roller continues to rotate at the second rotation speed while the heater is in use, thus eliminating a variation in the temperature of the developer roller in the circumferential direction thereof due to radiant heat of the photoconductive drum heated by the heater, which prevents thermal deformation of the developer roller and thus effectively prevents image fogging, concentration unevenness, and the like. The second rotation speed is set lower than the first rotation speed; thus, toner deterioration in the development unit can also be suppressed.

In the image forming apparatus with the configuration described above, the development unit is independently driven.

According to this configuration, the developer roller can be rotated at the second rotation speed regardless of driving of other units arranged in the image formation part.

In the image forming apparatus with the configuration described above, the driver is connected to the development unit via a clutch.

According to this configuration, only the development unit can be separately driven with simple configuration.

In the image forming apparatus with the configuration described above, the driver includes a first driver for driving the image formation part excluding the development unit and a second driver for driving the development unit.

According to this configuration, only the development unit can be separately driven with simple configuration.

In the image forming apparatus with the configuration described above, the controller intermittently drives the developer roller during the non-image formation period while the heater is in use.

According to this configuration, during the non-image formation period while the heater is in use, the developer roller is repeatedly driven at the second rotation speed and stopped, thereby permitting preventing the thermal deformation of the developer roller and also further reducing the cumulative drive time of the development unit.

In the image forming apparatus with the configuration described above, conditional formula (1) below is satisfied:

$$5/2B<T1\leqq 15/B \quad (1),$$

where

T1 is a drive time of the developer roller per the intermittent driving, and B is the second rotation speed.

According to this configuration, effect of preventing the thermal deformation of the developer roller and effect of preventing the toner deterioration in the development unit can be provided satisfactorily.

In the image forming apparatus with the configuration described above, conditional formula (2) below is satisfied:

$$(T1+T2)/T1\leqq B \quad (2),$$

where

T1 is a drive time of the developer roller per intermittent driving,

T2 is a stop time of the developer roller per intermittent driving, and

B is the second rotation speed.

According to this configuration, a variation in the temperature of the developer roller is further reduced to thereby more effectively prevent the thermal deformation.

DETAILED DESCRIPTION OF THE PREFERRED EMBODIMENTS

Figure 1:
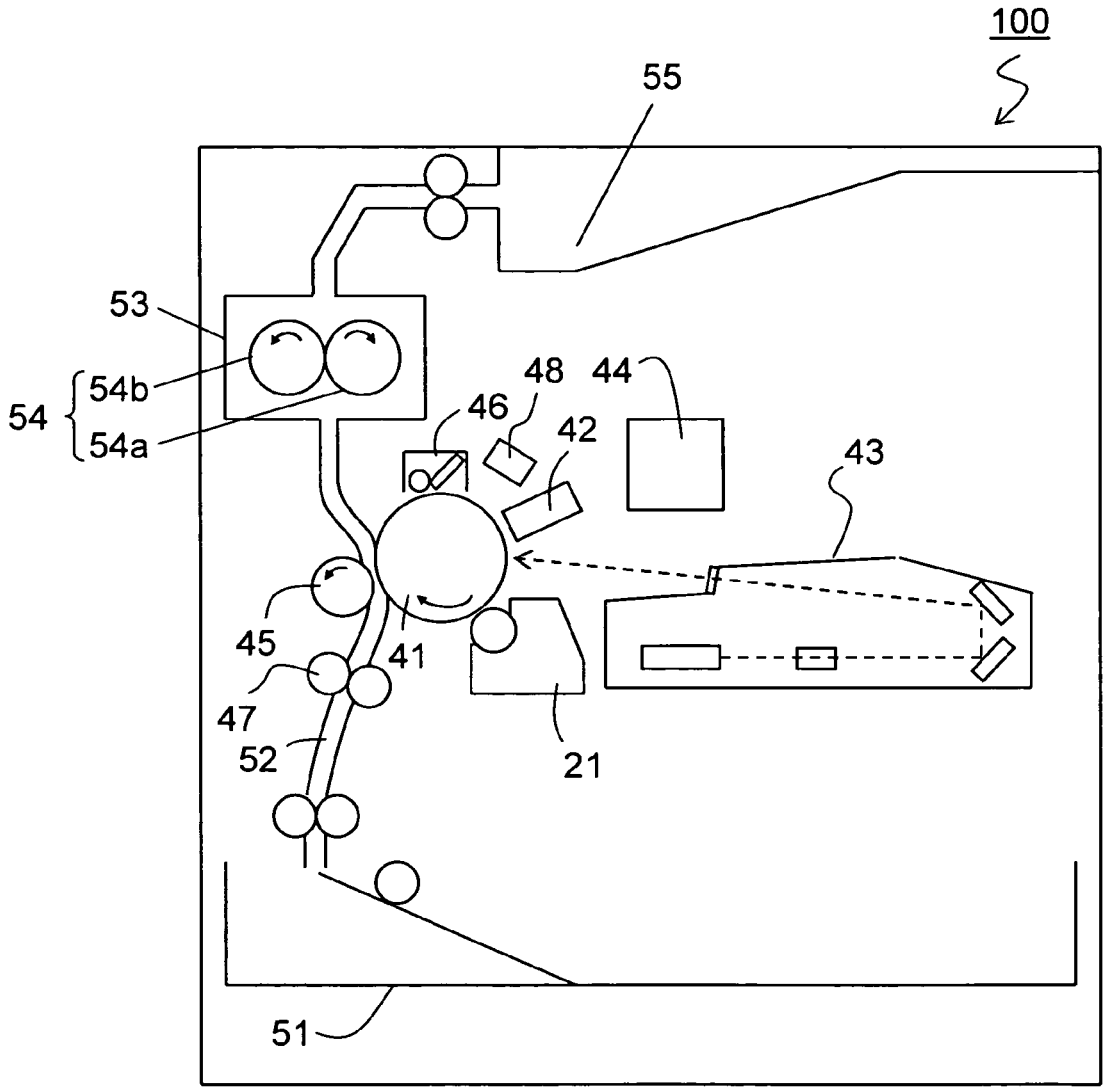
FIG. 1 is a schematic diagram showing the overall structure of an image forming apparatus of the invention.
Figure 8:
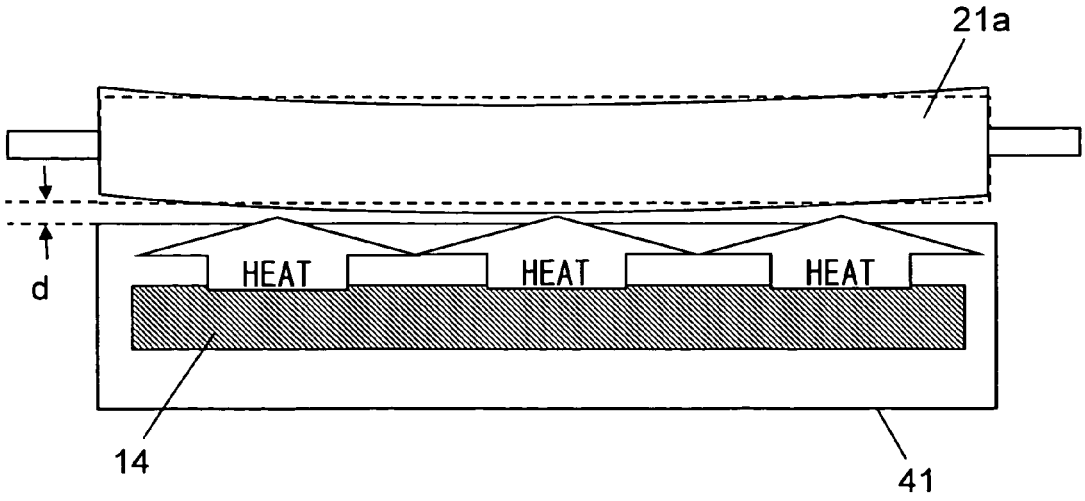
FIG. 8 is a schematic plan view showing thermal deformation of a developer roller.

Hereinafter, the embodiments of the present invention will be described with reference to the accompanying drawings. FIG. 1 is a schematic sectional view of an image forming apparatus of the invention. Portions in common to those of FIG. 8 in the conventional example are provided with the same numerals and thus omitted from the description. This image forming apparatus (for example, printer) 100 is composed of a photoconductive drum 41, a charge part 42, an image writing part 43, a development unit 21, a toner container 44, a transfer part 45, a cleaning part 46, a registration roller pair 47, an electricity removing device 48, a sheet storage part 51, a conveyance part 52, a fixing device 53, and a sheet discharge part 55.

The toner container 44 supplies a toner to the development unit 21 when a toner in the development unit 21 runs out, and also stores reserve toner. The registration roller pair 47 once suspends a sheet conveyed from the sheet storage part 51, and conveys the sheet again in accordance with a timing of image formation performed on the photoconductive drum 41. The sheet storage part 51 stores a sheet (recording medium, such as paper, an OHP, sheet or the like) on which a image (toner image) is finally printed, and also delivers the sheet to the conveyance part 52, i.e., a sheet path from the sheet storage part 51 to the discharge part 55.

The fixing device 53 has a fixing roller pair 54 composed of a heat roller 54*a* and a pressure roller 54*b*, and transforms a toner image transferred onto a sheet into a stable permanent image, and fuses and fixes the powdered toner image by supplying energy, such as heat, pressure, and the like, by using the fixing roller pair 54. The discharge part 55 stores a sheet that has passed through the fixing device 53, that is, the sheet with a permanent image printed thereon.

Once the user starts image formation operation, a sheet is conveyed from the sheet storage part 51 to the registration roller pair 47 via the conveyance part 52 (primary sheet feed). At this point, an image write signal turns ON, and, based on image data transmitted from a personal computer (PC), not shown, the image writing part 43 emits a laser beam (ray of light) onto the surface of the photoconductive drum 41 to thereby form, onto the surface of the photoconductive drum 41, an electrostatic latent image based on this image data.

Then, the development unit 21 has toner adhere to the electrostatic latent image (forms a toner image), and also the sheet is delivered from the registration roller pair 47 in accordance with the timing of toner image formation (secondary sheet feed). Then, the toner image is transferred onto the sheet by the transfer part 45 which has been supplied with a predetermined transfer voltage. Next, the fixing device 53 applies heat and the like to the sheet with the transferred toner image thereon, whereby the toner image is transformed into a permanent image. Meanwhile, the residual toner on the photoconductive drum 41 and the surface potential thereon are removed by the cleaning part 46 and the electricity removing device 48, respectively, and then preparation is made for initial charge by the charge part 42 and subsequent formation of a new toner image.

Figure 2:
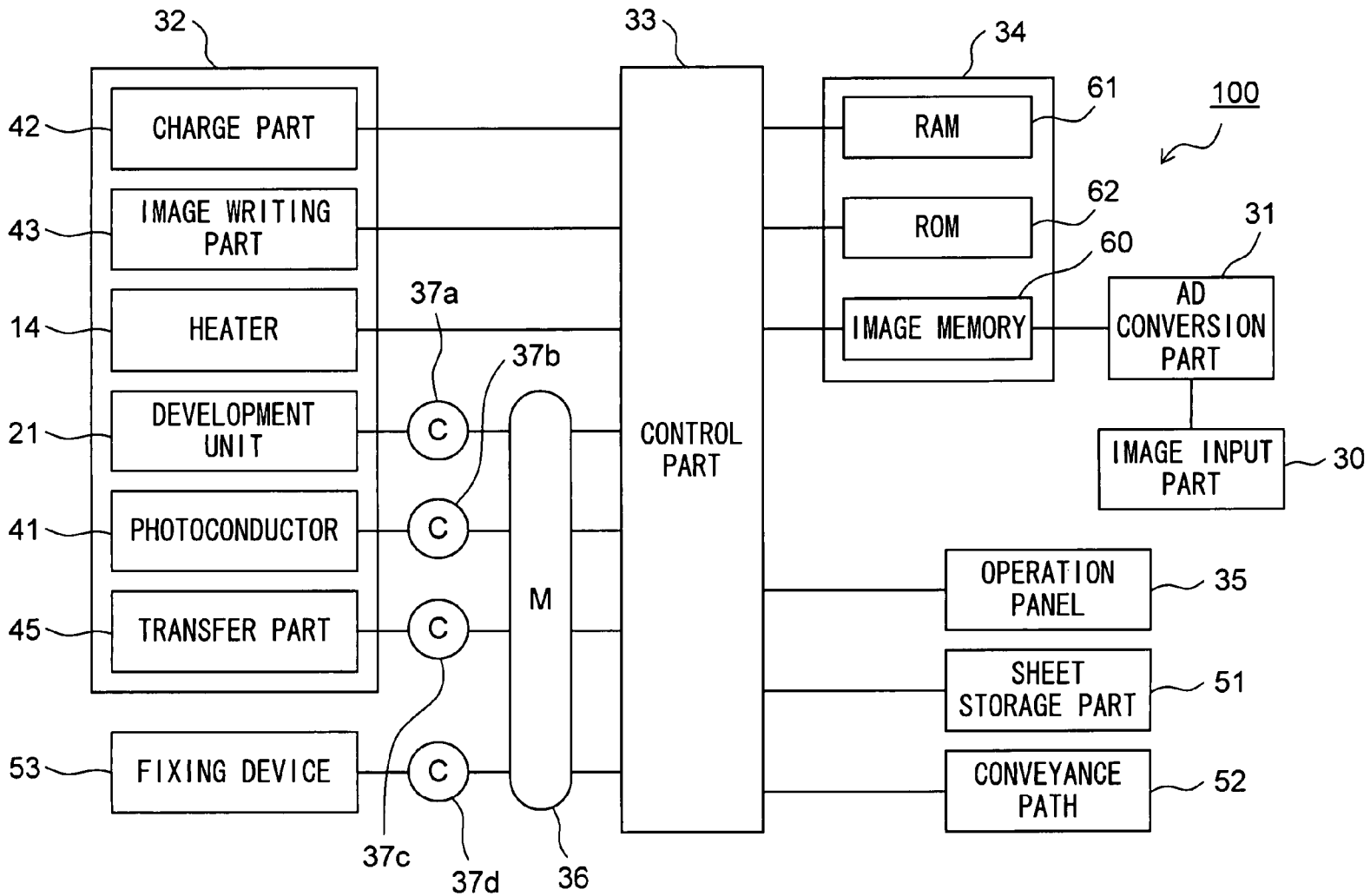
FIG. 2 is a block diagram showing the configuration of an image forming apparatus according to a first embodiment of the invention.

FIG. 2 is a block diagram showing the configuration of the image forming apparatus according to a first embodiment of the invention. Portions in common with those in FIG. 1 are provided with the same numerals and thus omitted from the description. The image forming apparatus 100 is composed of: an image input part 30, an AD conversion part 31, an image formation part 32, a control part 33, a storage part 34, an operation panel 35, a main motor 36, clutches 37*a* to 37*d*, the sheet storage part 51, the conveyance part 52, and the fixing device 53.

The image input part 30 is, in a case where the image forming apparatus 100 is a copier, an image reading part composed of: a scanning optical system loaded with a scanner lamp for illuminating a document at the time of copying and a mirror for changing the optical path of reflected light from the document; a condensing lens for condensing and focusing the reflected light from the document; a CCD for converting the focused image light into an electrical signal; and the like.

The image input part 30 is, in a case where the image forming apparatus 100 is a printer, a reception part that receives image data transmitted from a personal computer or the like. An image signal inputted by the image input part 30 is converted into a digital signal by the AD conversion part 31 and then delivered to an image memory 60 included in the storage part 34 to be described later.

The image formation part 32 includes: a heater 14, the photoconductive drum 41, the charge part 42, the image writing part 43, the development unit 21, and the transfer part 45. Based on a digital signal generated by conversion by the AD conversion part 31, the image formation part 32 forms onto the photoconductive drum 41 an electrostatic latent image, then develops it into a toner image by the development unit 21, and then transfers the toner image onto a sheet by the transfer part 45.

As the heater 14, a planer (sheet-type) heater is used, which is fitted along the inner side of the photoconductive drum 41 by making use of elastic property of the sheet. Moreover, the heater 14 undergoes ON/OFF control by a thermostatic reed switch, a thermistor, or the like to be maintained at a fixed temperature when in use.

The storage part 34 is provided with: the image memory 60, a RAM 61, and a ROM62. The image memory 60 stores an image signal read by the image reading part 30 and digitally converted by the AD conversion part 31, and delivers the image signal to the control part 33. The RAM61 and ROM62 store programs, contents, and the like of processing performed by the control part 33.

In addition, stored in the RAM 61 (or ROM 62) is normal a rotation speed of the developer roller 21*a* during a image formation period (hereinafter, referred to as first rotation speed) and a rotation speed, slower than the first rotation speed, during a non-image formation period while the heater 14 is in use (hereinafter, referred to as second rotation speed). As described later, these rotation speeds are delivered to the control part 33 for controlling the driving of the development unit 21, based on whether or not image formation is performed and whether or not the heater 14 is turned on.

The operation panel 35 is composed of: an operation part made up of a plurality of operation keys, and a display part for displaying the setting condition, status, and the like of the apparatus, both not shown. The operation panel 35 is used for the user to set print condition and the like, and, in a case where the image forming apparatus 100 has a facsimile function, is also used for various settings, such as registration of transmission destinations into the storage part 34, further reading and writing of the registered transmission destinations, and the like.

The main motor 36 drives, in accordance with a control signal from the control part 33, the sheet storage part 51, the conveyance part 52, the fixing device 53, and also the development unit 21, the photoconductive drum 41, and the transfer part 45 all the three included in the image formation part 32, and the like. The main motor 36 is connected, via clutches 37*a* to 37*d*, to the development unit 21, the photoconductive drum 41, the transfer part 45, and the fixing device 53, and is capable of controlling the driving of the development unit 21 independently from the photoconductive drum 41, the transfer part 45, and the like by engaging or disengaging the clutches 37*a* to 37*d* in accordance with a control signal from the control part 33. As the clutches 37*a* to 37*d*, electromagnetic clutches are used which transmit and cut the drive force by the current being turned ON and OFF.

The control part 33 performs overall control of the image input part 30, the image formation part 32, the sheet storage part 51, the fixing device 53, the main motor 36 and the clutches 37*a* to 37*d* controlling the aforementioned parts, in accordance with a set program, and also converts an image signal inputted from the image input part 30 into image data by performing magnification variation processing or gradation processing thereon as appropriate. The image writing part 43, based on image data already processed, emits laser light to form a latent image on the photoconductive drum 41. Further, the control part 33 has a function of controlling the driving of the development unit 21, based on whether or not an image is formed and whether or not the heater 14 is in use.

The invention is characterized in that, during the non-image formation period while the heater 14 is in use, the developer roller 21*a* rotates at the second rotation speed which is slower than the normal rotation speed (first rotation speed) employed during the image formation period. As a result, even during the non-image formation period, since the developer roller 21*a* continues to rotate at the second rotation speed when the heater 14 is in use, deformation of the developer roller 21*a* caused by radiant heat of the photoconductive drum 41 can be prevented, which in turn effectively prevents occurrence of image fogging, concentration unevenness, and the like. The second rotation speed, which is set lower than the first rotation speed, can control toner deterioration in the development unit 21 more than is achieved when the developer roller 21*a* continues to rotate at the first rotation speed.

The invention is effective, in particular, in application of the development unit 21 employing a one-component development system, which is more susceptible to the heat from the heater 14 due to a smaller gap between the photoconductive drum 41 and the developer roller 21*a* compared to a two-component development system, or a non-contact type jumping development system, which is more susceptible to the gap between the photoconductive drum 41 and the developer roller 21*a* due to toner dispersion caused by an electric field compared to a contact-type.

The use of the developer roller 21*a* formed of metal, such as aluminum, stainless (SUS), or the like, provides a higher heat conductivity, thus resulting in less risk of local deformation, compared to the use of an elastic roller, such as a rubber roller or the like.

Figure 7:
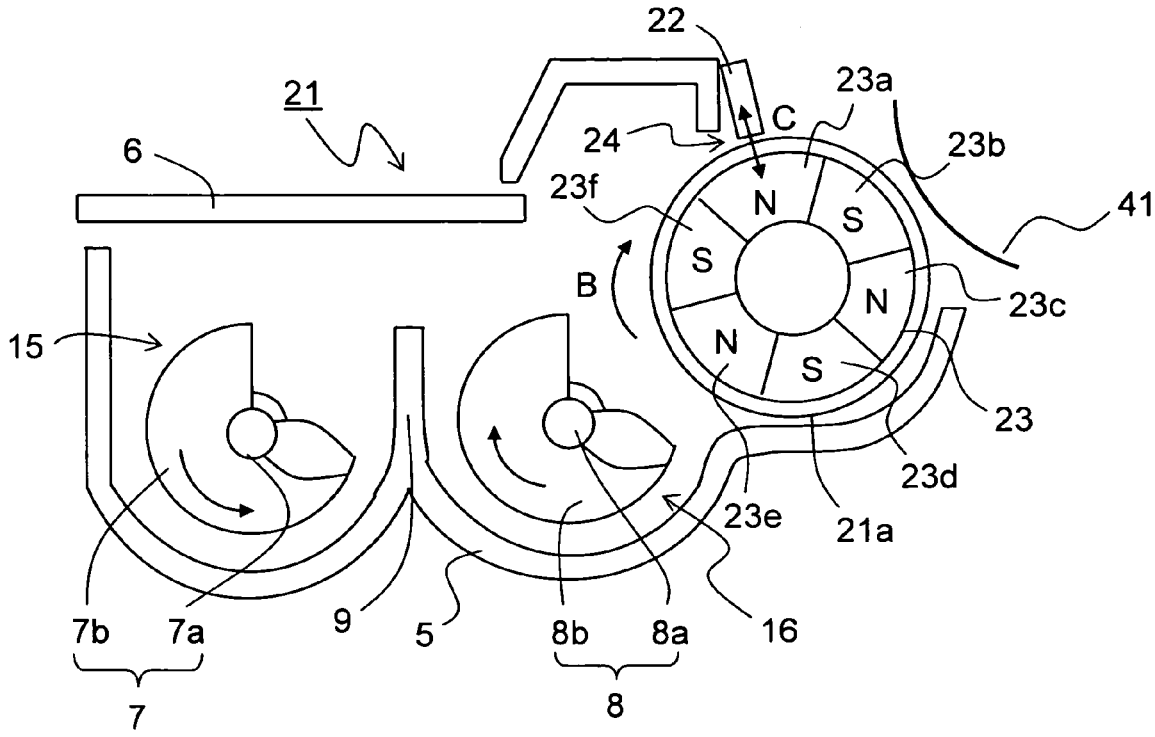
FIG. 7 is a side sectional view of a conventional development unit.

Further, if a configuration is provided such that only the developer roller 21*a* in the development unit 21 is capable of being driven to rotate, the first agitation screw 7 and the second agitation screw 8 (see FIG. 7 for the both) do not rotate and thus the toner is not agitated more than necessary. This reduces mechanical stress placed on the toner in the development unit 21, thus even more effectively suppressing the toner deterioration. In this case, the toner in the development unit 21 does not circulate; thus, the toner temperature around the developer roller 21*a* slightly rises. However, once the image formation processing starts and the toner circulates again, the toner temperature immediately becomes uniformized, with no risk of influencing the image formation.

Figure 3:
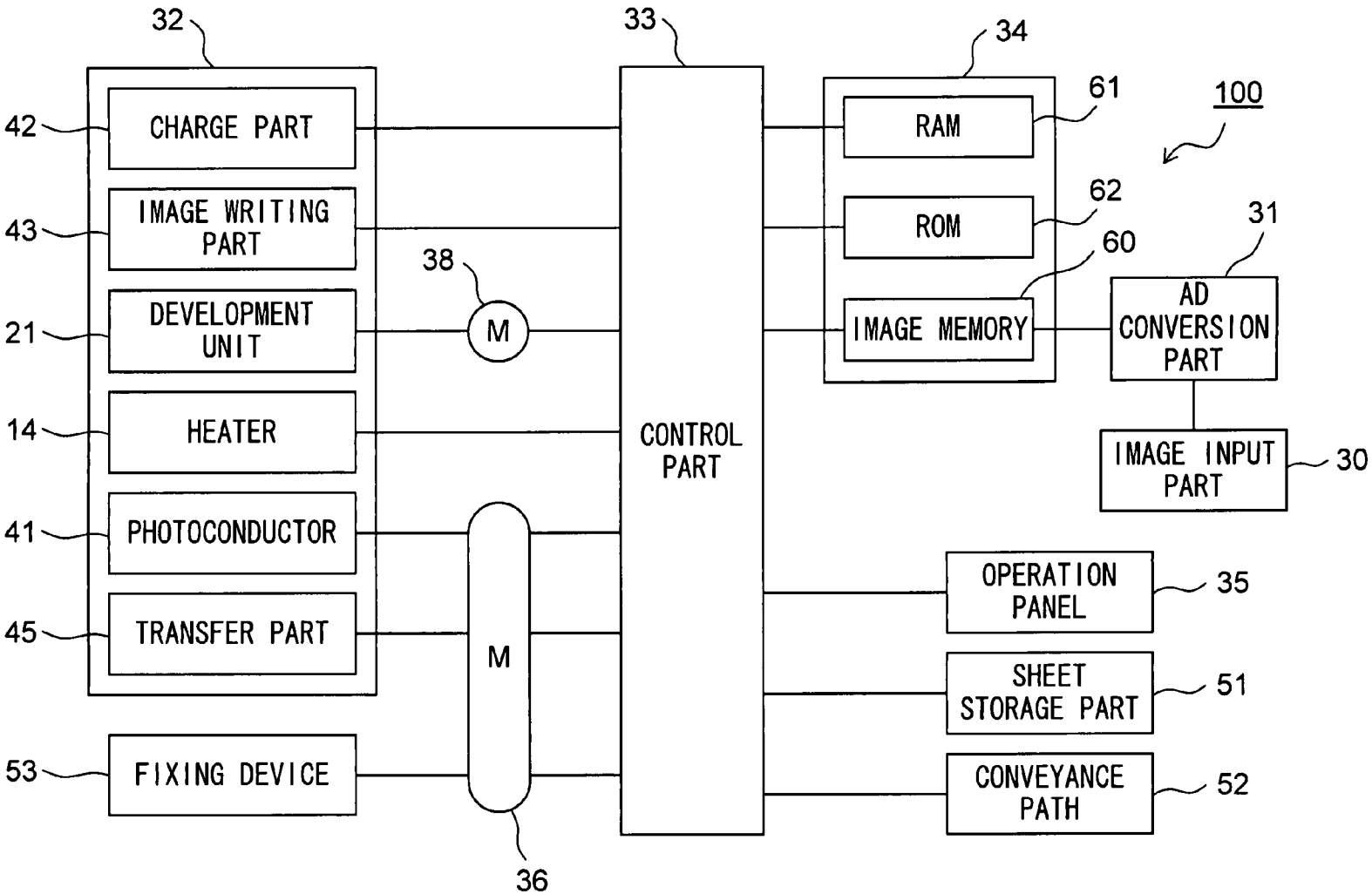
FIG. 3 is a block diagram showing the configuration of an image forming apparatus according to a second embodiment of the invention.

FIG. 3 is a block diagram showing the configuration of the image forming apparatus according to a second embodiment of the invention. In this embodiment, the clutches 37*a* to 37*d* of the first embodiment are not provided, and provided therein instead are: a main motor 36 (first drive) for driving the sheet storage part 51, the conveyance part 52, the fixing device 53, the photoconductive drum 41, and the transfer part 45; and a sub motor 38 (second driver) for driving the development unit 21. The configuration of other portions is common to those in the first embodiment of FIG. 2, and thus omitted from the description.

Therefore, like in the first embodiment, the driving of the development unit 21 can also be controlled independently in this embodiment by turning ON and OFF the driving of the sub motor 38, thus permitting control of the toner deterioration in the development unit 21 and also permitting effectively preventing image failure caused by the thermal deformation of the developer roller. Moreover, even when the main motor 36 is in a resting state, the development unit 21 can be driven; thus, the running costs of the apparatus can be cut more than the case of the first embodiment. As the sub motor 38, it is preferable to use a pulse motor, such as a stepping motor or the like, whose speed can easily be controlled.

Figure 4:
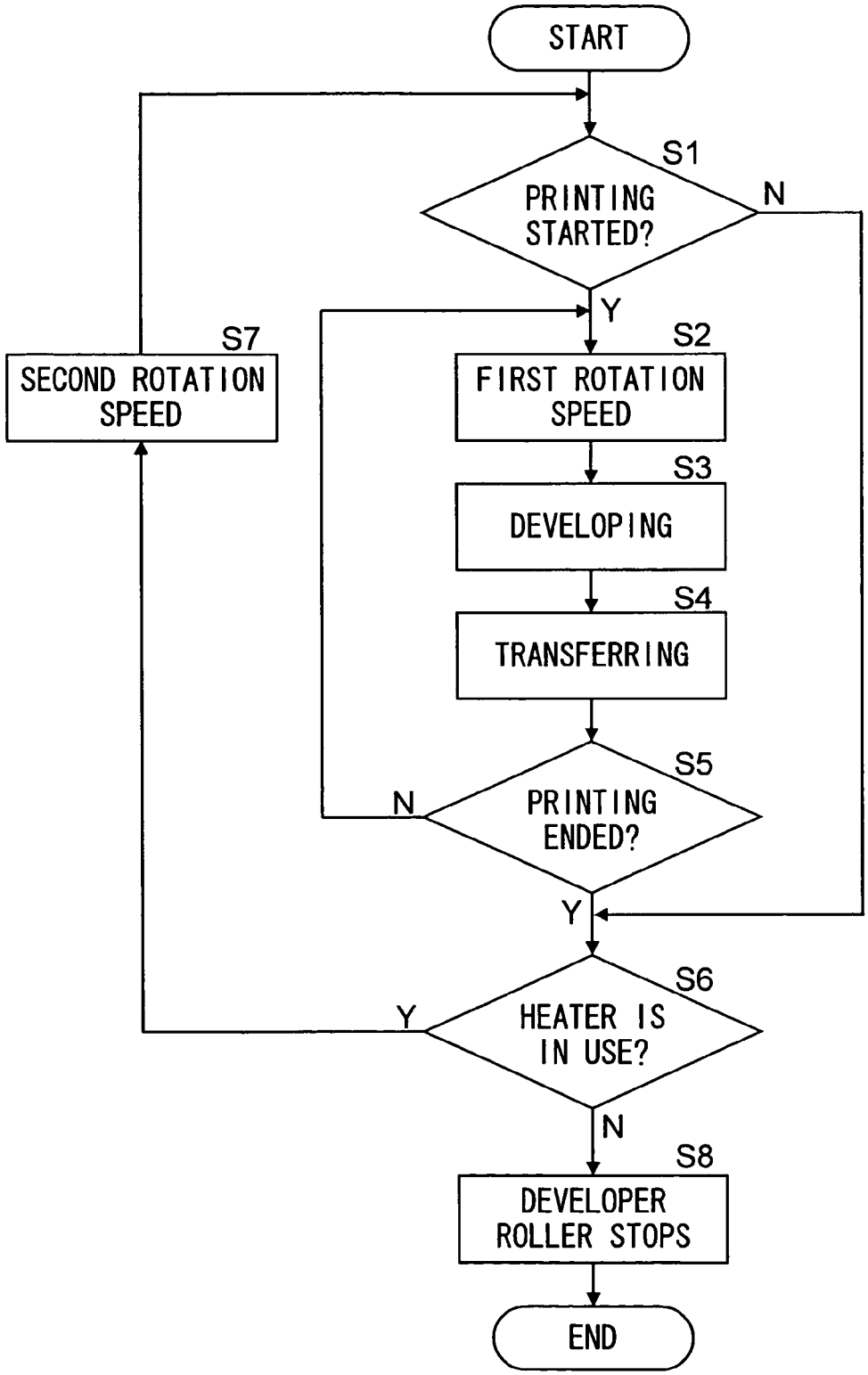
FIG. 4 is a flowchart showing procedures of controlling the driving of a development unit in the image forming apparatus of the invention.

Next, operation control of the development unit performed by the image forming apparatus of the invention will be described. FIG. 4 is a flowchart showing image formation operation performed by the image forming apparatus of the first embodiment. In accordance with steps of FIG. 4 while referring to FIG. 2, procedures of controlling the rotation speed of the developer roller 21*a* will be described.

First, it is determined whether or not printing has started by, for example, operation of the operation panel by the user (step S1). If printing has started, the control part 33 rotates the developer roller 21*a* at the first rotation speed stored in the storage part 34 (step S2), and then develops an electrostatic latent image formed on the photoconductive drum 41 based on the print data (step S3). Then, the registration roller pair 47 rotates at a predetermined timing, and a sheet is conveyed to the transfer part 45 in accordance with the image formation timing, whereby a toner image is transferred onto the sheet at the transfer part 45 (step S4). Heat and pressure are then applied to the toner image by the fixing device 53 to thereby transform it into a permanent image, and then the sheet is discharged outside the apparatus.

Next, it is determined whether or not the printing has ended (step S5). If the printing is still in progress, the processing returns to step S2 to repeat the same procedures (step S2 to S4). On the other hand, if the printing has not yet started in step S1, and if the printing has ended in step S5, it is determined whether or not the heater 14 is in use (step S6).

If the heater 14 is in use, the control part 33 disengages the clutch 37*b* to 37*d* to stop the driving of the respective parts of the apparatus other than the development unit 21 and also rotates the developer roller 21*a* at the second rotation speed stored in the storage part 34 by using a speed reducer of the clutch 37*a* (step S7). Then, the processing returns to S1 to repeat the same procedures thereafter (step S1 to S6). If the heater 14 is not in use in step S6, the clutches 37*a* to 37*d* are disengaged to stop the respective parts of the apparatus including the developer roller 21*a* (step S8), and then processing ends.

The description above refers to the image forming apparatus of the first embodiment in which the development unit 21 can be independently driven by providing the clutches 37*a* to 37*d*, but this description is also applicable to the image forming apparatus of second embodiment in which the sub motor 38 for driving the development unit 21 is provided independently from the main motor 36. In this case, the rotation speed of the sub motor 38 may be controlled based on whether or not the printing has started and whether or not the heater 14 is turned on.

It is well known that toner deterioration in the development unit 21 is promoted proportionally to the drive time of the development unit. Thus, it is preferable that the driving of the development unit 21 be stopped to a maximum extent during the non-image formation period. Thus, providing intermittent driving, in which driving and stopping are performed repeatedly, to rotate the developer roller 21*a* at the second rotation speed permits a reduction in the cumulative drive time of the development unit 21.

To reduce a variation in the temperature of the developer roller 21*a* in the circumferential direction and thereby prevent the thermal deformation thereof, a longer drive time per one intermittent driving is more preferable, although this also results in a longer cumulative drive time thus promoting the toner deterioration in the development unit 21. Thus, investigation made on the relationship among the drive time per intermittent driving, the thermal deformation of the developer roller 21*a*, and the toner deterioration thereof has proved that setting the rotation angle of the developer roller 21*a* per intermittent driving in the range between 15 degrees exclusive and 90 degrees inclusive can prevent the thermal deformation of the developer roller 21*a* while also effectively suppressing the toner deterioration in the development unit 21.

Where the drive time per intermittent driving is T1 (in seconds), the outer diameter of the developer roller 21*a* is S (in mm), and the second rotation speed is B (in rpm), the outer circumferential length of the developer roller 21*a* is S×π (in mm); thus, the circumferential length of the movement of the developer roller 21*a* per driving is S×π×T1×B/60 (in mm). Since the rotation angle of the developer roller 21*a* per intermittent driving is between 15 degrees exclusive and 90 degrees inclusive, the circumferential length of the movement of the developer roller 21*a* per driving with respect to the outer circumferential length of the developer roller 21*a*, that is, (S×π×T1×B/60)/(S×π), may be set between 15 degrees/360 degrees exclusive but and 90 degrees/360 degrees inclusive.

Therefore, $15/360<(S\times\pi\times T1\times B/60)/(S\times\pi)\leqq 90/360$, that is, $1/24<T1\times B/60\leqq 1/4$ is obtained. Thus, preventing both the toner deterioration in the development unit and the thermal deformation of the developer roller can be achieved by setting the drive time T1 and the rotation speed B so that conditional formula (1) below is satisfied:

$$5/2B<T1\leqq 15/B \quad (1).$$

Moreover, in order to reduce the mechanical stress placed on the toner in the development unit 21 to thereby suppress the toner deterioration, a slower rotation cycle of the developer roller 21*a* is more preferable, although a variation in the temperature of the developer roller 21*a* in the circumferential direction is likely to occur. Thus, investigation made on the relationship between the rotation cycle and thermal deformation of the developer roller 21*a* has proved that setting the rotation cycle of the developer roller 21*a* at 60 seconds or below can reduce the variation in the temperature of the developer roller 21*a* to thereby effectively prevent the thermal deformation.

The number of intermittent driving required for one rotation of the developer roller 21*a* is represented by:

$$\text{(Outer circumferential length)/(circumferential length of movement per driving)}=(S\times\pi)/(S\times\pi\times T1\times B/60).$$

Assuming that the stopping time per intermittent driving is T2 (in seconds), the time required for one intermittent driving is represented by (T1+T2). Thus, the rotation cycle of the developer roller 21*a* is:

$$\text{(the number of intermittent driving required for one rotation of the developer roller)}\times\text{(time required for one intermittent driving)}=(S\times\pi)/(S\times\pi\times T1\times B/60)\times(T1+T2).$$

Therefore, $(S\times\pi)/(S\times\pi\times T1\times B/60\times(T1+T2)\leqq 60$, that is, $(T1+T2)/(T1\cdot B/60)\leqq 60$ is obtained. Thus, the drive time T1, the stopping time T2, and the rotation speed B may be set so that conditional formula (2) below is fulfilled:

$$(T1+T2)/T1<B \quad (2).$$

The procedures of operation control of the development unit 21 is exactly the same as those of FIG. 4, with only a difference in that, instead of continuously rotating the developer roller 21*a* at the second rotation speed, the intermittent driving as described above is employed, and thus is omitted from the description.

The invention is not limited to the embodiments described above, and thus various modifications are permitted without departing from the sprit of the invention. For example, the invention is applicable to various image forming apparatuses using a development unit, such as: copiers including digital complex copiers, tandem-type color copiers, analog-type monochrome copiers, and the like; facsimiles; laser printers; and the like.

EXAMPLES

By using the image forming apparatus of the invention, investigation has been made on effect of suppressing image failure when continuous printing is performed. By using, as a test machine, the image forming apparatus of the first embodiment that drives the development unit 21 independently from the clutches 37*a* to 37*d*, a variation in the distance between the photoconductive drum 41 and the developer roller 21*a* and the occurrence of image failure have been investigated for a case where the driving of the development unit 21 has been controlled based on whether or not the heater 14 is in use during the non-image formation period (the developer roller 21*a* is intermittently driven) (the invention) and a case where the driving of the development unit 21 has not been controlled (the developer roller 21*a* is stopped) (comparative example).

The photoconductive drum used is an amorphous silicon drum having an outer diameter of 84 mm, a film thickness of 35 μm, a dark potential of 410V, and a bright potential of 20V, with a drum circumferential speed set at 450 mm/sec. The development unit employs a magnetic jumping development method, and a developing bias was applied which was obtained by superimposing an AC having a frequency of 2.3 kHz, a Duty of 55%, and a peak to peak voltage of 1.6 kV on a DC 230V. The developer roller used has a magnetic field generating member, having a 6-poles structure including N1, S1, N2, S2, N3, and S3, fixed in a roller of SUS316 having an outer diameter of 25 mm and a surface roughness (Rz) of 4.0 μm.

The surface roughness Rz of the developer roller is measured by JIS B0601-1994 (ten point average roughness). Setting has been made so that the drive time T1 per intermittent operation of the developer roller is 1 second, the stopping time thereof is 4 seconds, the rotation speed of the developer roller (second rotation speed) is 5 rpm, the rotation cycle is 60 seconds, and a distance d between the photoconductive drum and the developer roller is 0.32 mm. As a testing method, a white solid image was printed after the heater has been kept on for five minutes during the non-image formation period to judge the presence of image fogging by visual check. In addition, measurements were also made on the distance d between the photoconductive drum and the developer roller at several areas in the longitudinal direction of the developer roller.

Figure 5A:
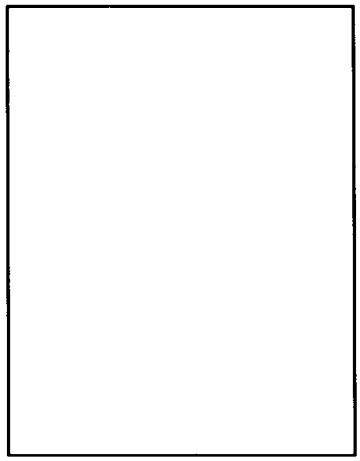
FIG. 5 is a diagram showing effect of reducing image failure when the driving of the development unit is controlled by using the image forming apparatus of the invention.
Figure 5B:
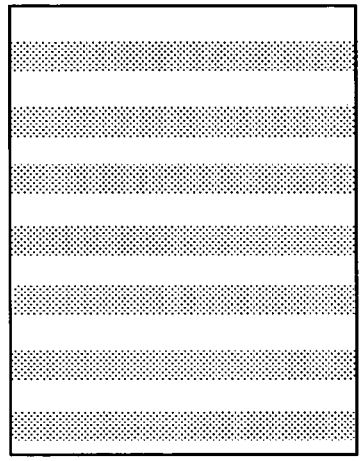
Figure 6:
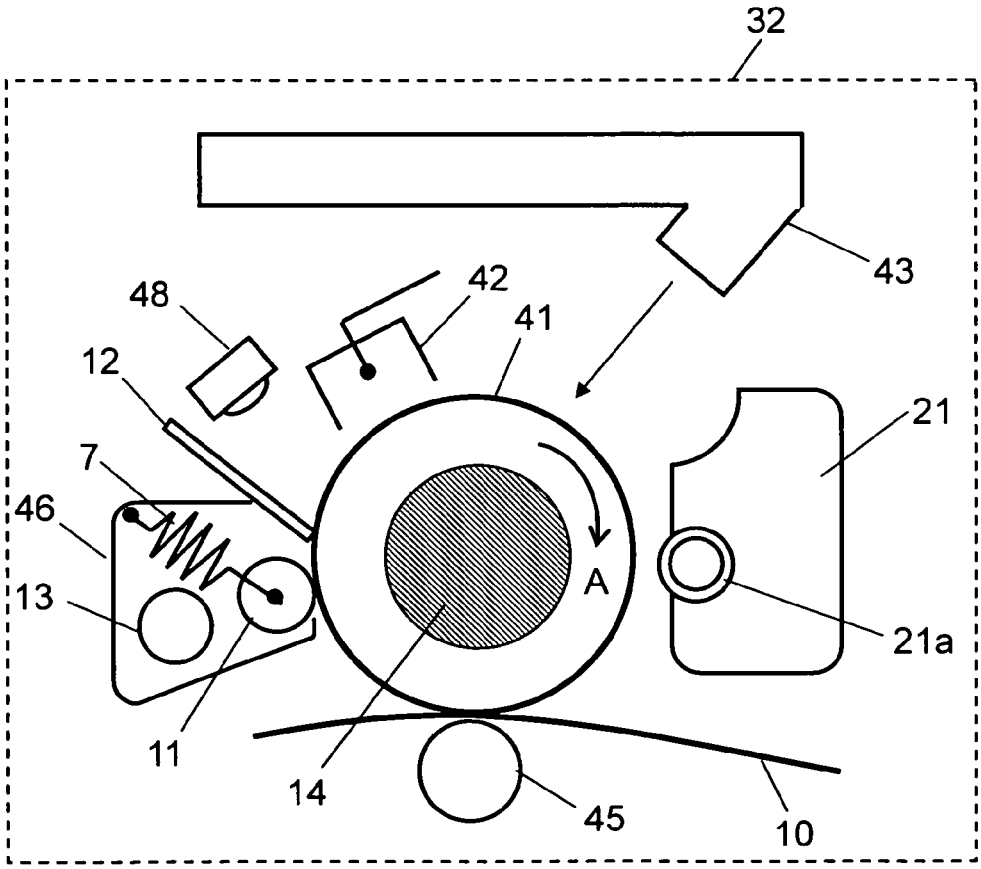
FIG. 6 is a schematic sectional view showing the structure of an image formation part of a conventional image forming apparatus.

In the invention in which the driving of the development unit is controlled based on whether or not the heater is in use during the non-image formation period, as shown in FIG. 5A, no image fogging occurred even five minutes after the use of the heater started. Moreover, the distance d between the photoconductive drum and the developer roller were substantially equal to the initial value regardless of which area was measured. On the other hand, in the comparative example in which the driving of the development unit is not controlled, as shown in FIG. 5B, image fogging was observed which appears in a periodical stripe pattern in the sheet conveyance direction (vertical direction of FIG. 5). Moreover, the distance d between the photoconductive drum and the developer roller measured was partially as narrow as down to 0.26 mm.

According to the invention, the image forming apparatus is provided which can eliminate a variation in the temperature of the developer roller in the circumferential direction thereof due to radiant heat from the photoconductive drum heated by the heater, thereby effectively preventing the thermal deformation of the developer roller and also suppressing the toner deterioration in the development unit.

Moreover, during the non-image formation period while the heater is in use, the developer roller performs intermittent operation of repeating driving at the second rotation speed and stopping, which permits preventing the thermal deformation of the developer roller and further reducing the cumulative drive time of the development unit to thereby more effectively suppress the toner deterioration in the development unit.

Furthermore, setting the rotation angle of the developer roller per intermittent operation between 15 degrees exclusive and 90 degrees inclusive and also setting the rotation cycle of the developer roller at 60 seconds or below provide intermittent operation condition that provides satisfactory effect of preventing the toner deterioration in the development unit and satisfactory effect of preventing the thermal deformation of the developer roller.

Further, the clutches lie between the driver and the development unit or the second driver for driving the development unit is provided, thus permitting independently driving only the development unit with simple configuration and making it even easier to control the driving of the development unit.

What is claimed is:

1. An image forming apparatus comprising:

an image formation part comprising: a photoconductive drum, a heater for heating the photoconductive drum to a predetermined temperature, and a development unit for forming a toner image onto a surface of the photoconductive drum in accordance with an electrostatic latent image by rotating a developer roller so arranged as to oppose the photoconductive drum;

a driver for driving the image formation part; and a controller for controlling driving of the driver, wherein the controller rotates the developer roller at a first rotation speed during an image formation period, rotates the developer roller at a second rotation speed, a speed lower that the first rotation speed, during a non-image formation period if the heater is in use, and stops the developer roller during the non-image formation period if the heater is not in use.

2. The image forming apparatus of claim 1, wherein the development unit is independently driven.

3. The image forming apparatus of claim 2, wherein the driver is connected to the development unit via a clutch.

4. The image forming apparatus of claim 1, wherein the controller intermittently drives the developer roller during the non-image formation period while the heater is in use.

5. The image forming apparatus of claim 2,
wherein the controller intermittently drives the developer roller during the non-image formation period while the heater is in use.

6. The image forming apparatus of claim 3,
wherein the controller intermittently drives the developer roller during the non-image formation period while the heater is in use.

7. The image forming apparatus of claim 4,
wherein conditional formula (1) below is satisfied:

$$5/2B<T1\leqq 15/B \quad (1),$$

where
T1 is a drive time of the developer roller per the intermittent driving, and
B is the second rotation speed.

8. The image forming apparatus of claim 5,
wherein conditional formula (1) below is satisfied:

$$5/2B<T1\leqq 15/B \quad (1),$$

where
T1 is a drive time of the developer roller per the intermittent driving, and
B is the second rotation speed.

9. The image forming apparatus of claim 6,
wherein conditional formula (1) below is satisfied:

$$5/2B<T1\leqq 15/B \quad (1),$$

where
T1 is a drive time of the developer roller per the intermittent driving, and
B is the second rotation speed.

10. The image forming apparatus of claim 4,
wherein conditional formula (2) below is satisfied:

$$(T1+T2)/T1\leqq B \quad (2),$$

where
T1 is a drive time of the developer roller per the intermittent driving,
T2 is a stop time of the developer roller per the intermittent driving, and
B is the second rotation speed.

11. The image forming apparatus of claim 5,
wherein conditional formula (2) below is satisfied:

$$(T1+T2)/T1\leqq B \quad (2),$$

where
T1 is a drive time of the developer roller per the intermittent driving,
T2 is a stop time of the developer roller per the intermittent driving, and
B is the second rotation speed.

12. The image forming apparatus of claim 6,
wherein conditional formula (2) below is satisfied:

$$(T1+T2)/T1\leqq B \quad (2),$$

where
T1 is a drive time of the developer roller per the intermittent driving,
T2 is a stop time of the developer roller per the intermittent driving, and
B is the second rotation speed.

13. The image forming apparatus of claim 7,
wherein conditional formula (2) below is satisfied:

$$(T1+T2)/T1\leqq B \quad (2),$$

where
T1 is a drive time of the developer roller per the intermittent driving,
T2 is a stop time of the developer roller per the intermittent driving, and
B is the second rotation speed.

14. The image forming apparatus of claim 8,
wherein conditional formula (2) below is satisfied:

$$(T1+T2)/T1\leqq B \quad (2),$$

where
T1 is a drive time of the developer roller per the intermittent driving,
T2 is a stop time of the developer roller per the intermittent driving, and
B is the second rotation speed.

15. The image forming apparatus of claim 9,
wherein conditional formula (2) below is satisfied:

$$(T1+T2)/T1\leqq B \quad (2),$$

where
T1 is a drive time of the developer roller per the intermittent driving,
T2 is a stop time of the developer roller per the intermittent driving, and
B is the second rotation speed.

16. An image forming apparatus comprising:
an image formation part comprising: a photoconductive drum, a heater for heating the photoconductive drum to a predetermined temperature, and a development unit for forming a toner image onto a surface of the photoconductive drum in accordance with an electrostatic latent image by rotating a developer roller so arranged as to oppose the photoconductive drum;
driver means for driving the image formation part; and
a controller for controlling driving,
wherein the controller rotates the developer roller at a first rotation speed during an image formation period, rotates the developer roller at a second rotation speed, a speed lower that the first rotation speed, during a non-image formation period if the heater is in use, and stops the developer roller during the non-image formation period if the heater is not in use; and
wherein the driver means includes a first driver for driving the image formation part excluding the development unit and a second driver for driving the development unit.

17. The image forming apparatus of claim 16,
wherein the controller intermittently drives the developer roller during the non-image formation period while the heater is in use.

18. The image forming apparatus of claim 17,
wherein conditional formula (1) below is satisfied:

$$5/2B<T1\leqq 15/B \quad (1),$$

where
T1 is a drive time of the developer roller per the intermittent driving, and
B is the second rotation speed.

19. The image forming apparatus of claim 17,
wherein conditional formula (2) below is satisfied:

$$(T1+T2)/T1\leqq B \quad (2),$$

where
T1 is a drive time of the developer roller per the intermittent driving,

T2 is a stop time of the developer roller per the intermittent driving, and

B is the second rotation speed.

20. The image forming apparatus of claim 18, wherein conditional formula (2) below is satisfied:

$$(T1+T2)/T1 \leqq B \quad (2),$$

where

T1 is a drive time of the developer roller per the intermittent driving,

T2 is a stop time of the developer roller per the intermittent driving, and

B is the second rotation speed.

21. An image forming apparatus comprising:

an image formation part comprising: a photoconductive drum, a heater for heating the photoconductive drum to a predetermined temperature, and a development unit for forming a toner image onto a surface of the photoconductive drum in accordance with an electrostatic latent image by rotating a developer roller so arranged as to oppose the photoconductive drum;

a driver for driving the image formation part; and a controller for controlling driving of the driver, wherein the controller drives the developer roller to rotate during an image formation period, intermittently drives the developer roller during a non-image formation period if the heater is in use, and stops the developer roller during the non-image formation period if the heater is not in use.

22. The image forming apparatus of claim 21, wherein conditional formula (1) below is satisfied:

$$5/2B < T1 \leqq 15/B \quad (1),$$

where

T1 is a drive time of the developer roller per the intermittent driving, and

B is a rotation speed of the developer roller during the intermittent driving.

23. The image forming apparatus of claim 21, wherein conditional formula (2) below is satisfied:

$$(T1+T2)/T1 \leqq B \quad (2),$$

where

T1 is a drive time of the developer roller per the intermittent driving,

T2 is a stop time of the developer roller per the intermittent driving, and

B is a rotation speed of the developer roller during the intermittent driving.

* * * * *